United States Patent [19]

Giordano

[11] Patent Number: 4,693,633

[45] Date of Patent: Sep. 15, 1987

[54] RUN-OFF TROUGH

[76] Inventor: Louis Giordano, P.O. Box 136, Linwood, N.J. 08221

[21] Appl. No.: 669,636

[22] Filed: Nov. 8, 1984

[51] Int. Cl.[4] ..... E02B 9/04; E04D 13/08

[52] U.S. Cl. ..... 405/119; 52/16

[58] Field of Search ..... 405/18, 19, 108, 115, 405/118, 119; 5/441; 297/DIG. 3; 52/11, 16

[56] References Cited

U.S. PATENT DOCUMENTS 3,561,219 2/1971 Nishizawa et al. ..... 405/19
4,345,853 8/1982 Fisher ..... 405/119
4,362,433 12/1982 Wagner et al. ..... 405/18 X
4,370,769 2/1983 Herzig et al. ..... 5/441 X

FOREIGN PATENT DOCUMENTS 279444 11/1970 U.S.S.R. ..... 405/119
573529 9/1977 U.S.S.R. ..... 405/119

*Primary Examiner*—David H. Corbin
*Attorney, Agent, or Firm*—Eric P. Schellin

[57] ABSTRACT

A run-off trough for a down spout associated with a gutter for a house or building which trough can be light in weight and easily portable to a down spout use location, and which can be easily modified at its use location to become sufficiently heavy that it is not easily displaceable therefrom unintentionally.

8 Claims, 4 Drawing Figures

FLUENT MATERIAL
10
12
14
16
20
22
24
30
40
50

10
16
18
20
22
30
44
55

14
3
10
4
30
20
22
12
40
24

14
55
10
30
18
16
55
44
32
24
12
50
40

RUN-OFF TROUGH

BACKGROUND OF THE INVENTION

1. Field of the Invention

The present invention relates to a run-off trough for a down spout associated with a gutter for a house or building. More particularly, the present invention relates to a run-off trough which can be light in weight and easily portable to a down spout use location, and which can be easily modified at its use location to become sufficiently heavy that it is not easily displaceable therefrom unintentionally.

2. Description of the Prior Art

It has previously been proposed to provide the down spouts of gutters with run-off troughs for carrying run-off water away from a house or building. Traditionally such run-off troughs have been formed of a block of dense material such as concrete with a trough-like depression in the top surface thereof. Due to their bulk and weight, such troughs are stable when installed at the bottom of a down spout, but they are difficult to handle and transport.

Recently, light-weight run-offs have been proposed which are formed from a thin sheet of molded plastic material having an outer configuration in the form of the top surface of a traditional concrete run-off. Due to their light weight, these troughs tend to move about or be blown away during a storm, and accordingly, it has been proposed that such troughs be secured by attachment to the end of the down spout (c.f., U.S. Pat. Nos. 3,084,479 and 4,345,853) or by attachment to the ground by long spikes. None of these methods has proven completely satisfactory.

SUMMARY OF THE INVENTION

In accordance with the present invention, a light-weight run-off trough easily portable to the base of a down spout but unintentionally displaceable therefrom only with difficulty comprises a light-weight molded plastic body having a top surface formed in the shape of a run-off trough, said body forming a hollow chamber adapted to hold and retain a charge of a fluent material substantially greater in weight than said light-weight plastic body, said body having therein an opening to permit charging said hollow body with such fluent material, whereby said run-off trough may easily be transported while empty into proximity of a down spout, and thereupon be filled with a heavy fluent charge and rendered unintentionally displaceable only with difficulty.

Also in accordance with the present invention is a run-off trough comprising a molded plastic body having a top surface formed in the shape of a run-off trough, said body forming an enclosed fluid-retaining hollow chamber, and a charge of a dense fluent material in said chamber.

Further in accordance with the present invention is a process which comprises forming a fluid-retaining light-weight hollow plastic body having a top surface in the shape of a run-off trough, transporting said light weight body into proximity of a down spout, filling and weighting said light weight hollow body while in proximity of said down spout with a charge of fluent material weighing at least three times the weight of said body, thereby substantially increasing the weight of said body and contents, and disposing said filled and weighted body with its run-off trough-shaped top surface directly under said down spout.

BRIEF DESCRIPTION OF THE DRAWINGS

Various features and advantages of the present invention will be more fully appreciated from the following detailed description when considered in connection with the accompanying drawings in which like reference characters designate like or corresponding parts throughout the several views and wherein.

DETAILED DESCRIPTION OF THE PREFERRED EMBODIMENTS

Figure 1:
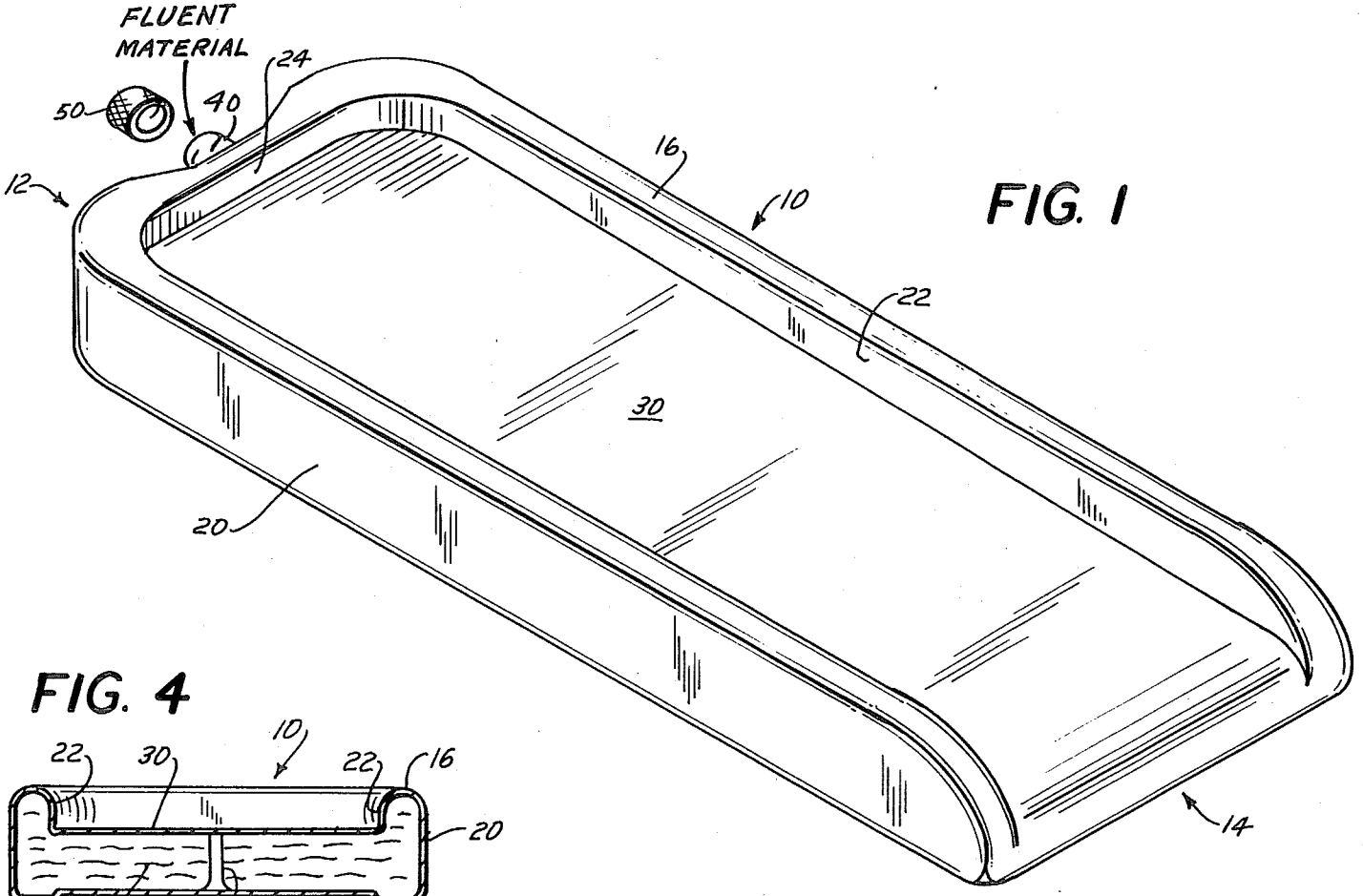
FIG. 1 is a view in perspective of the run-off trough of the present invention, showing the trough-shaped top surface, a threaded filling opening, and a closure cap therefor.
Figure 4:
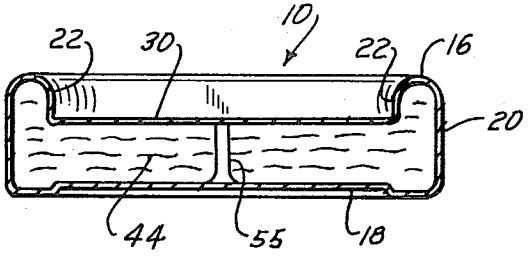
FIG. 4 is a view in transverse cross section taken in the plane indicated by the arrows at the line 4—4 of FIG. 1.
Figure 2:
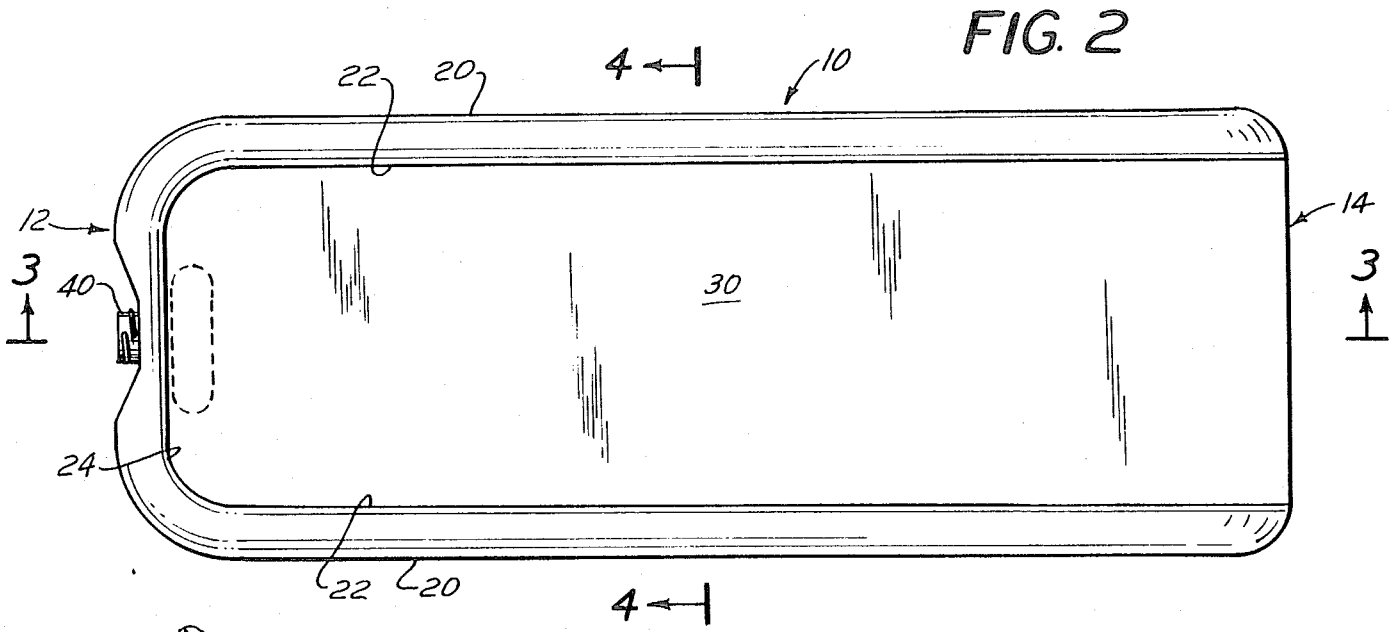
FIG. 2 is a top plan view of the run-off trough of FIG. 1.
Figure 3:
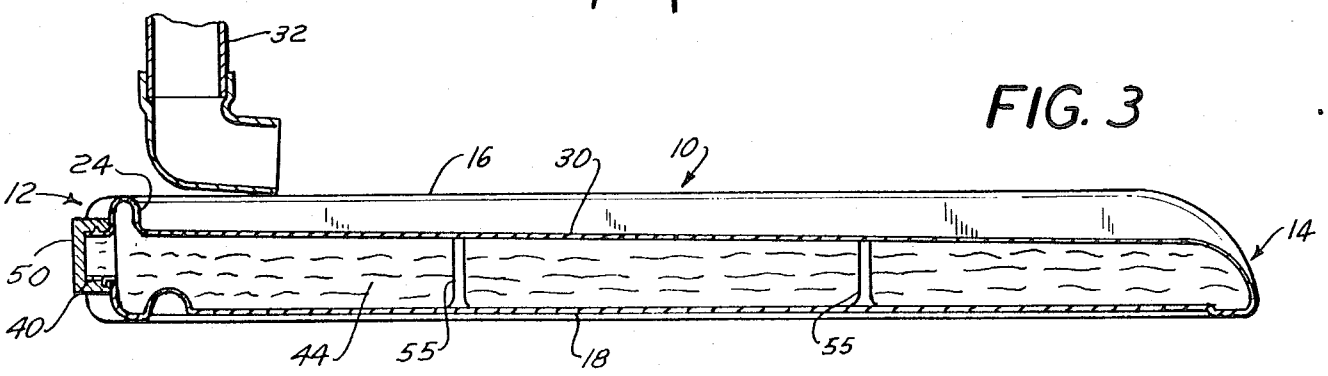
FIG. 3 is a view in longitudinal cross section of the device of FIG. 1 taken in the plane indicated by the arrows at line 13—13 of FIG. 1, with a vestigial bottom end of a down spout additionally being shown.

As seen in the Figures, the run-off trough of the present invention is formed by blow molding a hollow body 10 of polyethylene fortified with inhibitors against decomposition by sunlight. For a standard size trough approximately one foot wide, two feet long, and two inches high, comparable to current concrete troughs, approximately one and one half pounds of polyethylene is used to blow mold the trough. The hollow body 10 is substantially rectangular and slightly tapered, thinning from a dammed back 12 to an open front 14. The hollow body 10 has a deeply recessed top wall 16, a slightly recedsed base 18, and substantially vertical side walls 20. The deeply recessed top wall 16 forms a trough defined by trough side surfaces 22, back surface 24, and trough bottom 30. The trough bottom 30 slopes downwardly from the dammed back 12 to the open front 14, providing an inclined channel for discharge of effluent water received from a down spout 32.

The base 18 contains a deep recess 34 near the back of the trough which provided as a finger-receiving recess to facilitate carrying of the tourgh when empty. The back 12 has molded therein a threaded open neck 40 designed to admit a charge of fluent weighting material 44 (water) into the hollow body 10 of the trough. The volume of the body of the trough is about one and one half gallons, and thus, when filled with water as a weighting charge, the body and contents weighs approximately fourteen pounds. A threaded cap 50 is provided to permit sealing or re-sealing of the threaded neck opening 40.

If the device is stood vertically on its front edge 14 for filling, there is a tendency for the plastic wall 30 and base 18 to flex apart or "balloon". In order to minimize such distortion, a pair of reinforcing columns 55 are molded to join the base 18 to the wall 30.

In use, the run-off trough of the present invention is blow molded of polyethylene and shipped, with cap, empty. A typical run-off trough has a contained volume of at least about 140 cubic inches and weighs, empty, from about one to two pounds, although the weight may vary somewhat depending on the size of the trough and the resin from which it is molded. Although polyethylene is the preferred resin material, other polymeric or plastic materials may be used such as polypropylene, polyvinyl chloride, polyvinylidene chloride, and like materials which can be formed into a hollow, fluid-holding and retaining trough body. Preferably, a trough body of the present invention holds at least five pounds of water or other liquid having a specific gravity of about 1, and more preferably the combined weight of both the body and the charge of fluent material therein is at least ten pounds.

The trough body is shipped in its empty condition to its use site, i.e., in proximity to a down spout. There it is filled with fluent material 44 of liquid, slurry, or particulate solid form. The fluent material is dense, having a specific gravity of at least about 1, and may be water, optionally with antifreeze and/or sand, or other materials such as mortar mix, uncured concrete, plaster mix, mud, dirt, dry sand, and the like.

Once filled, the trough typically weighs at least five and preferably from ten to about thirty pounds. The filled, heavy trough is disposed at the bottom of the down spout 32 with which it is to be used, and is sufficiently heavy that it is not easily unintentionally displaceable, as by wind, storms, and the like, and is also free of any need for securement to either the down spout, the building structure, or the surface on which it rests.

Obviously, numerous modifications and variations of the present invention are possible in the light of the above disclosure. It is therefore to be understood that within the ambit of the appended claims, the invention may be practiced otherwise than as specifically described herein.

What is claimed is:

1. A light-weight splash block easily portable to the base of a down spout but unintentionally displaceable therefrom only with difficulty comprising a light-weight molded rigid plastic body means having a top surface formed in the shape of a run-off trough means for directing water away from a downspout, said body means forming a hollow chamber adapted to hold and retain a charge of a fluent material substantially greater in weight than said light-weight molded rigid plastic body, said body means having therein an opening to permit charging said hollow body with such fluent material, whereby said splash block may easily be transported while empty into proximity of a down spout, and thereupon be filled with a heavy fluent charge and rendered thereby sufficiently heavy to be unintentionally displaceable only with difficulty.

2. A light-weight splash block as set forth in claim 1 in which said opening is closeable.

3. A light-weight splash block as set forth in claim 1 which includes means for closing said opening.

4. A light-weight splash block as set forth in claim 1 in which said hollow chamber has a volume of at least about 140 cubic inches and in which said body weighs from about one to two pounds.

5. A process for providing a splash block, comprising the following steps: forming a fluid-retaining light-weight hollow plastic body having a top surface in the shape of a run-off trough for directing water away from a downspout, transporting said light-weight body into proximity of a down spout, filling and weighting said hollow body while in proximity of said down spout with a charge of fluent material weighting at lest about three times the weight of said hollow body, thereby substantially increasing the weight of said body and contents, and disposing said filled and weighted body with its run-off trough-shaped top surface directly under said down spout.

6. A process as set forth in claim 5 in which said fluent material is aqueous.

7. A process as set forth in claim 5 in which said fluent material contains sand.

8. A process as set forth in claim 5 in which said fluent material is concrete.

* * * * *